United States Patent [19]

Martin et al.

[11] Patent Number: 4,899,716

[45] Date of Patent: Feb. 13, 1990

[54] ARROW REST

[75] Inventors: Terry G. Martin; George T. Newbold, both of Walla Walla, Wash.; Theodore M. Davenport, Corbett, Oreg.

[73] Assignee: Martin Archery, Inc., Walla Walla, Wash.

[21] Appl. No.: 291,758

[22] Filed: Dec. 28, 1988

Related U.S. Application Data

[63] Continuation-in-part of Ser. No. 216,782, Jul. 8, 1988, abandoned.

[51] Int. Cl.[4] ..... F41B 5/00

[52] U.S. Cl. ..... 124/41 A; 124/24 R

[58] Field of Search ..... 124/41 A, 24 R, 26, 124/86, 88; 403/381, 362, 113, 116, 120

[56] References Cited

U.S. PATENT DOCUMENTS

| | | | |
|---|---|---|---|
| 2,743,716 | 5/1956 | Wendt | 124/41 A |
| 3,108,584 | 10/1963 | Coe | 124/24 R |
| 3,285,237 | 11/1966 | Wolfe . | |
| 3,372,686 | 3/1968 | Losh . | |
| 3,494,347 | 2/1970 | Saunders . | |
| 3,865,096 | 2/1975 | Troncoso, Jr. . | |
| 3,871,352 | 3/1975 | Stanislawski et al. . | |
| 3,935,854 | 3/1976 | Troncosco, Jr. . | |
| 4,278,066 | 7/1981 | Zinz, Sr. | 124/41 A |
| 4,299,195 | 11/1981 | Norris . | |
| 4,332,232 | 6/1982 | Troncoso, Jr. . | |
| 4,398,528 | 8/1983 | Troncoso, Jr. . | |
| 4,436,468 | 3/1984 | Ozaki et al. | 403/362 X |
| 4,476,846 | 10/1984 | Carville | 124/41 A |
| 4,489,704 | 12/1984 | Troncoso, Jr. . | |
| 4,579,101 | 4/1986 | Bateman, III | 124/24 R X |
| 4,584,189 | 10/1985 | Pietraszek et al. . | |
| 4,664,093 | 5/1987 | Nunemaker . | |
| 4,748,964 | 6/1988 | Troncoso, Jr. | 124/24 R X |

OTHER PUBLICATIONS

"Martin for the Serious Archer", Archery World, 4/1988.
Martin Arrow Rests, Catalog 1988, 8/1988.
Bowhunters Warehouse Catalog 1988, 8/1988, p. 37.
*Bowhunter*, Oct./Nov., p. 81, 142.
*Archery World*, Jul. 1973, p. 46.
*Archery*, Jul. p, 42.
*Archery*, Jul. 1966, vol. 38, No. 7, p. 46.
*Archery World*, 1981, p. 42.
Stemmer Archery, Inc. Catalog, p. 18.
Archer Retailer, Dec. 1982.
Martin Archery, Inc. Catalog 1987, pp. 18–19.

*Primary Examiner*—Randolph A. Reese
*Assistant Examiner*—Peter M. Cuomo
*Attorney, Agent, or Firm*—Wells, St. John & Roberts

[57] ABSTRACT

An arrow rest apparatus for an archery bow includes a base, a support bar extending from the base, and a support block slidably mounted to the support bar. The support block and the support bar have a dovetail sliding interconnection to enable sliding movement of the support block along the support bar, but to preclude any rotation of the support block about the support bar. The support block is selectively lockable relative to the support bar to set the support block at the desired position. An arrow launcher is pivotally mounted by the support block and includes a fore end adapted for receiving an arrow. The fore end is upwardly biased by a tapered spring. A first set screw engages the tapered spring enabling its compression to be adjusted and correspondingly the force required to pivot the arrow launcher about its pivot axis. A second set screw engages the aft end of the arrow launcher enabling the resting elevation of the arrow receiving portion to be selectively varied.

14 Claims, 3 Drawing Sheets

Fig 1
PRIOR ART
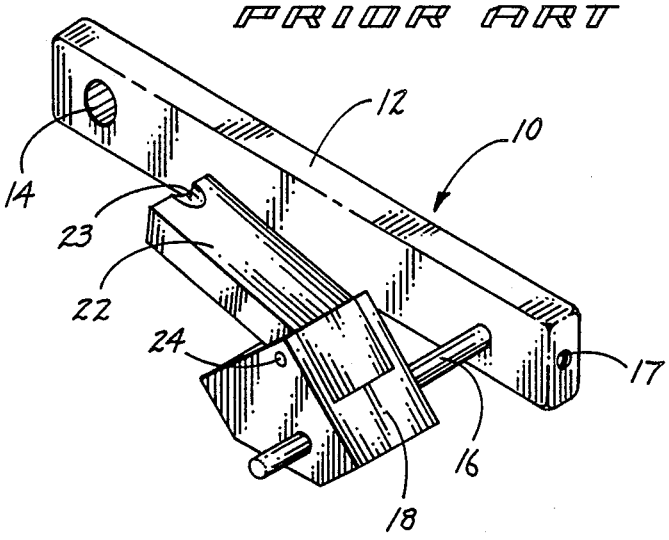
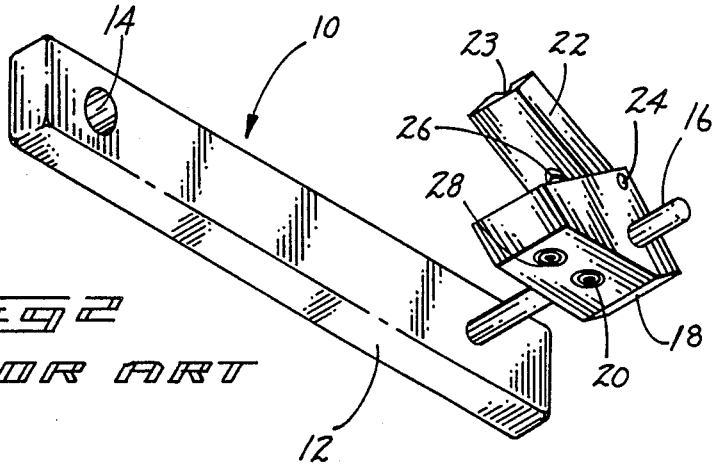
Fig 2
PRIOR ART

ARROW REST

This is a continuation-in-part of our U.S. patent Ser. No. 216,782 (abandoned).

TECHNICAL FIELD

This invention relates to arrow rests for archery bows.

BACKGROUND OF THE INVENTION

Many arrow rests are available today for an archer's choosing, such as is indicated on pages 18 and 19 of the 1987 Martin Archery Catalogue.

Another arrow rest is illustrated in FIGS. 1 and 2 of this document and is labeled as being prior art. This arrow rest, indicated generally by reference numeral 10, includes an elongated base 12 having a hole 14 formed in one end thereof. A bolt (not shown) extends through hole 14 and threads into a hole on the bow for securing rest 10 relative to the bow. A round support bar 16 is firmly connected at the opposite base end and extends perpendicularly therefrom. A set screw 17 threads inwardly from the end of base 12 to secure support bar 16 from rotation relative to base 12. A support block 18 is mounted to and slidable along support bar 16. A set screw 20 is threadable relative to support block 18 and engages support bar 16 to selectively lock support block 18 from sliding and rotating relative to support bar 16. An arrow launcher 22 is pivotally mounted to support block 18 for pivotal movement about a pivot pin 24. Arrow launcher 22 has a fore slot 23 within which an arrow is adapted to rest. A cylindrical coil spring 26 extends between and engages support block 18 and launcher 22 at a location forward of pivot pin 24. The spring 26 biases the forward end of launcher 22 upwardly. A set screw 28 is threadable relative to support block 18 and directly contacts the end of coil spring 26 which, in turn, contacts launcher 22. Selective threading of set screw 28 enables adjustment of the compression provided by the coil spring and accordingly the force required to pivot arrow launcher 22 about pivot pin 24.

The prior art arrow rest 10, although an improvement over many other prior art arrow rests, is not without drawbacks. For example, it is extremely difficult for an archer to adjust the position of support block 18 slidably along support bar 16 without imparting a rotational force to the support block. This affects the elevation of arrow receiving slot 23. This is not desirable, as many times the archer merely wishes to change the position of the launcher of the arrow rest relative to the bow without affecting arrow resting elevation. A further problem is related to spring 26 extending between launcher 22 and support block 18. For example, threading of set screw 28 inwardly to change the spring compression has a tendency to cause cylindrical spring 26 to bow or bulge outward. This either produces a negligible effect or renders the device completely inoperable.

The invention overcomes these and other drawbacks of the prior art.

BRIEF DESCRIPTION OF THE DRAWINGS

The preferred embodiment of the invention is illustrated in the accompanying drawings, in which:

FIG. 1 is a left rear, downward perspective view of the prior art arrow launcher discussed in the "Background of the Invention" section of this document;

FIG. 2 is a right front, upward perspective view of the prior art arrow rest shown in FIG. 1;

DETAILED DESCRIPTION OF THE PREFERRED EMBODIMENT

Figure 3:
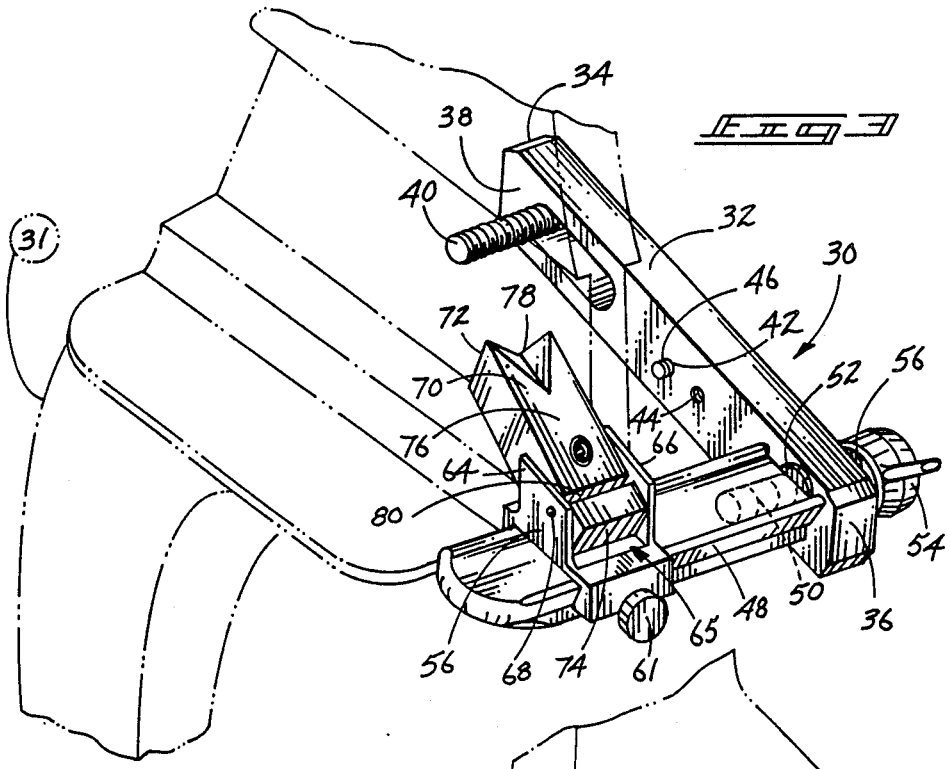
FIG. 3 is a left rear perspective view of a preferred embodiment of an arrow rest of this invention in which the arrow rest is mounted to an archery bow handle shown in phantom.
Figure 4:
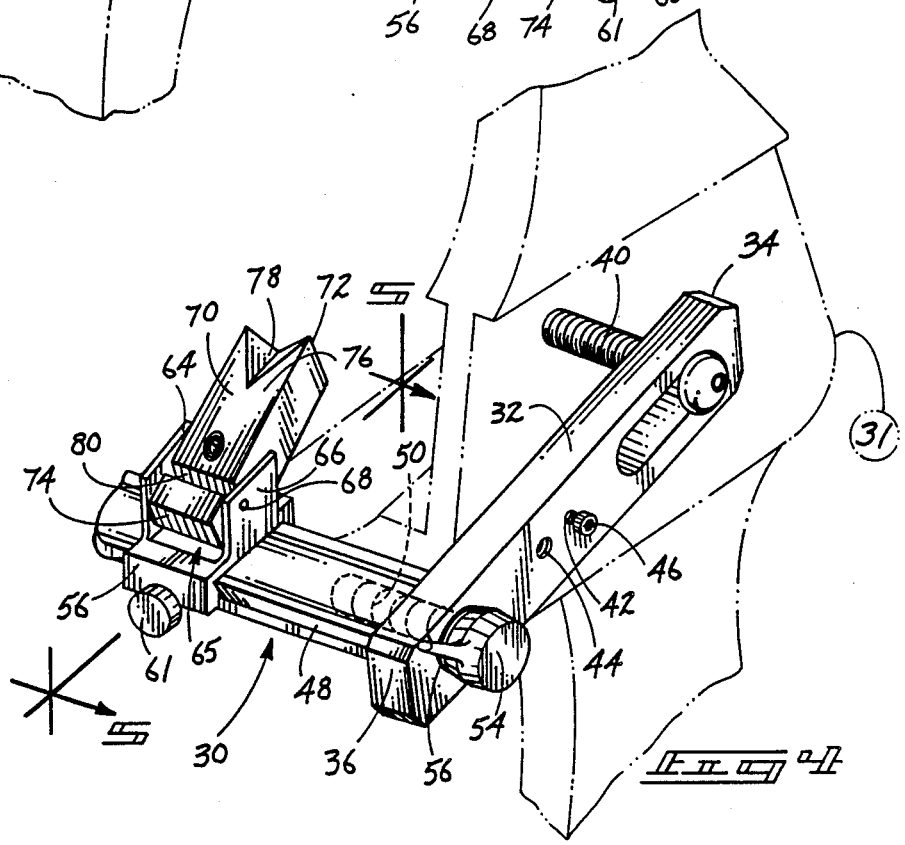
FIG. 4 is a right rear perspective view of the arrow rest illustrated in FIG. 3.

The following disclosure of the invention is submitted in compliance with the constitutional purpose of the Patent Laws "to promote the progress of science and useful arts" (Article 1, Section 8).

Referring to FIGS. 3–6, a preferred embodiment of an arrow rest apparatus in accordance with the invention, for mounting to an archery bow 31, is indicated generally by reference numeral 30. Arrow rest apparatus 30 includes an elongated base 32 which is securably mounted to bow 31. Base 32 includes a fore end 34 and an aft end 36. A longitudinally elongated slot 38 is formed transversally through base 32 adjacent fore end 34. A bolt 40 extends through opening 38 and tightly threads to a hole in bow 31 for rigidly securing base 32 relative thereto. The elongated nature of slot 38 enables various positional adjustments of base 32 relative to bow 31. A pair of threaded holes 42, 44 also extends through base 32 at its middle section adjacent opening 38. A locking screw 46 is receivable by at least one of these holes. Screw 46 bears against bow 31 to provide an additional securing effect of base 32 to bow 31, if desired.

An elongated support bar or guide 48 extends generally perpendicularly from adjacent aft end 36 of base 32. Support bar 48 is pivotal relative to base 32 by means of a bolt 50 which extends through base 32 and threads into a hole (not shown) in the inner end of support bar 48. Bolt 50 serves both as a pivoting mount for support bar 48 and as a locking means for securing support bar 48 relative to base 32. In this manner, support bar 48 may be oriented at selected angular positions relative to base 32. A lock washer 52 is received between support bar 48 and base 32 about bolt 50 to better enable selective locking of support bar 48 relative to base 32. Bolt 50 is a standard Allen socket screw having an appropriately configured plastic cap 54 secured thereto. Cap 54 includes a winged head portion which enables an archer to quickly and easily adjust the angular positioning of support bar 48 relative to base 32. A plastic washer 56 extends about bolt 50 and is received between base 32 and head 54. Support bar 48 is of a male dovetail shape in lateral cross-section along its length.

A support block or carriage 56 is slidably mounted to support bar 48. The bottom of support block 56 includes a complementary dovetail slot or opening 58 corresponding in size for receiving the male dovetail cross-sectional configuration of support bar 48. This dovetail interconnection functions as an interlocking discontinuity interconnection between support bar 48 and support block 56. Alternately, the dovetail can be considered as a support means for slidably supporting the support block on the elongated support bar. The dovetail arrangement enables sliding movement of the support block 56 along the support bar 48 but precludes any rotation of the support block 56 relative to support bar 48. In the depicted embodiment, support block 56 is removable from support bar 48 only by sliding support block 56 completely off the left end of support bar 48.

The aft end of support block 56 includes a threaded opening 60 (FIGS. 5–6) and a locking set screw 62 received therein. Set screw 62 is another standard Allen socket screw also having an appropriately configured plastic cap 61 secured thereto. A small nylon pellet 63 is provided within threaded opening 60 between the end of set screw 62 and support bar 48. When set screw 62 is first tightened against support bar 48, pellet 63 is extruded to conform to the shape of the support bar surface against which it bears. This provides a larger contact area for securely clamping support block 46 against support bar 48, and also provides the advantage of preventing scratching of support bar 48 by the end of set screw 62. Set screw 62 engages against support bar 48, through pellet 63, to selectively lock the support block 56 to support bar 48 at various positions along the length thereof. Set screw 62 functions as a releasable clamping means for enabling the position of support block 56 to be selectively varied. Alternate clamping means could also be used without departing from the principles and scope of the invention.

Support block 56 includes a pair of upwardly projecting side walls 64, 66 which define a channel 65 therebetween. A pivot pin 68 is connected to and extends between support walls 64 and 66 through channel 65.

An elongated arrow launcher 70 having fore and aft ends 72, 74 respectively, is received in channel 65 between walls 64 and 66. Arrow launcher 70 has an elongated upper surface 76, a bottom surface 77, and a width which substantially fills channel 65 between walls 64 and 66. A V-shaped arrow receiving grove 78 is formed in launcher fore end 72 in its upper surface 76. A transverse slot 80, having a slot base or floor 82, extends downwardly into launcher 70 from its upper surface 76 at a position between ends 72 and 74. More specifically, slot 80 extends across the launcher width near aft end 74. Pivot pin 68 is received in launcher slot 80 and engages slot base 82.

Figure 7:
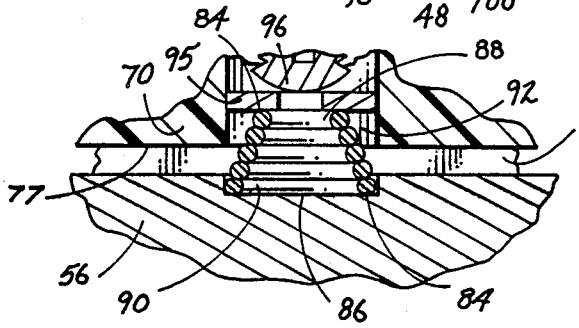
FIG. 7 is an enlarged sectional view illustrating compression properties of a spring used in accordance with the invention.

A spring 84 biases fore end 72 of launcher 70 upwardly against pivot pin 68. In this manner, launcher 70 is pivotally mounted to support block 56 for pivoting about a generally horizontal pivot axis defined by pivot pin 68, and is positioned between launcher fore and aft ends 72, 74. More particularly, spring 84 is preferably a coil spring of a predetermined compression which extends between and engages support block 56 and launcher 70 at locations forward of pivot pin 68. Spring 84 is tapered or conical along its length to facilitate compression and alleviate outward bowing of the spring upon being compressed (see FIG. 7). This is an improvement over use of cylindrical springs of constant diameter which have a tendency to bow outwardly or jam, thereby adversely affecting the operation of the rest. In the depicted embodiment, spring 84 is wider at its lower end 86 where it engages support block 56 than at its upper end 88 where it engages arrow launcher 70.

A recess 90 is formed in support block 56 to receive lower spring end 86 to properly maintain such end in the desired position relative to support block 56. During assembly, a dab of adhesive is preferably provided in recess 90 to maintain lower end 86 of coil spring 84 within recess 90 and relative to the other components to assist in the assembly.

An adjustment or first threaded opening 94 is formed in launcher 70 and extends from upper surface 76 downwardly into the launcher. First threaded opening 94 has a predetermined average diameter extending across the opening between the mid points of the high and low thread edges. A compression set screw 96 is received within first threaded opening 94.

A counterbore 92 is formed in launcher 70 and extends upwardly into launcher 70 from launcher bottom surface 77. Counterbore 92 is longitudinally aligned with, and communicates with, first threaded opening 94. Counterbore 92 has a predetermined diameter which is greater than the first threaded opening 94 average diameter. Upper end 88 of coil spring 84 extends into counterbore 92 for engagement with compression set screw 96. A disk or washer 95 is received within counterbore 92 and is interposed between coil spring upper end 88 and first threaded opening 94.

Rotation of set screw 96 into and out of first threaded opening 94 adjusts the relative compression of spring 84. In this manner, set screw 96 functions as an adjustment means for enabling selective adjustment of the compression in coil spring 84, and accordingly the force required to pivot arrow launcher 70 about its pivot axis as defined by pivot pin 68. A threaded opening and set screw alternately could be provided in support block 56 to adjustably engage lower spring end 86 to provide the same compression adjusting effect. Preferably, the length of the counterbore equals or exceeds the length of set screw 96 to prevent the set screw from being threaded inwardly so far that upper end 88 of spring 84 is ejected from counterbore 92.

Adjustable stop means is positioned aft of pivot pin 68 for limiting the upward pivotal movement of launcher fore end 72 relative to support block 56 to a selective predetermined resting elevation. The lower portion of aft end 74 of launcher 70 has an inclined rear surface 98 that may bear flushly against support block 56.

The stop means is preferably constructed to be adjustable to enable selective elevational adjustment of the resting elevation of launcher fore end 72, and correspondingly the arrow receiving V-groove 78. As shown, this adjustable stop means is provided in the form of a stop or second threaded opening 100 which extends from channel 65 through the bottom portion of support block 56 to female dovetail slot 58. A stop set screw 102 is received in second opening 100 and abuts launcher 70 against inclined surface 98 just aft of pivot pin 68.

Figure 5:
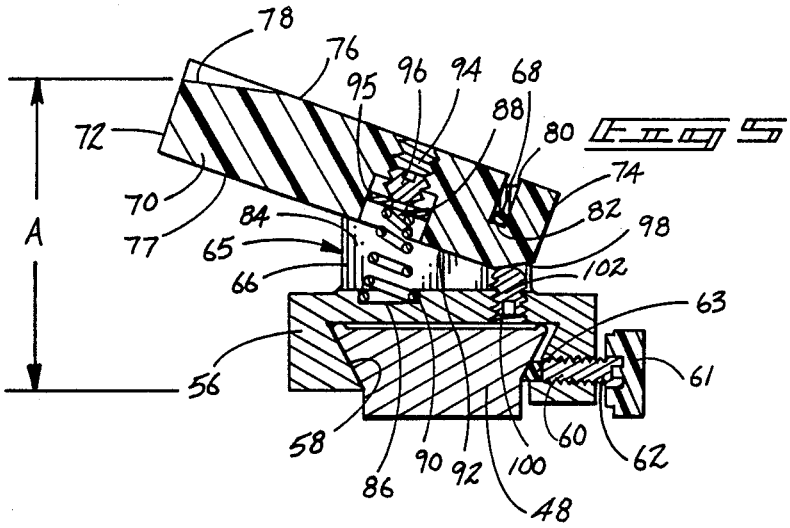
FIG. 5 is an enlarged cross-sectional view taken along line 5—5 in FIG. 4.
Figure 6:
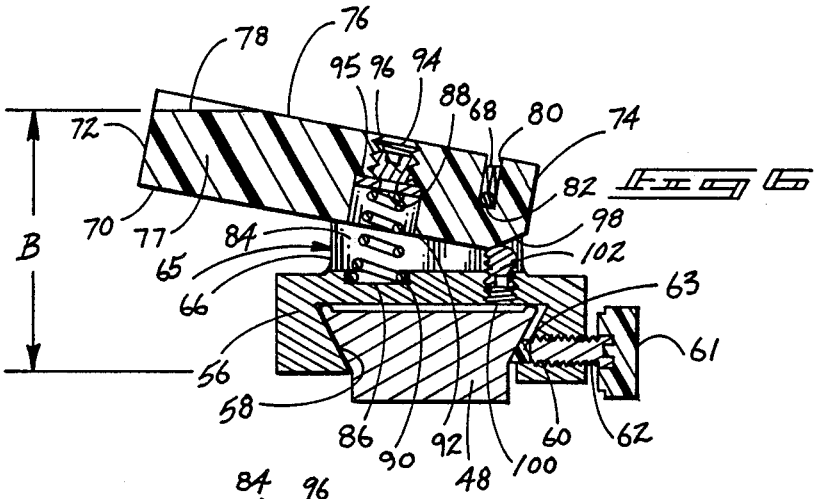
FIG. 6 is similar to FIG. 5, but illustrates the arrow rest in an alternate adjusted position from that illustrated in FIG. 5.

FIG. 5 illustrates inward threading of set screw 102 relative to opening 100 to a first degree which defines a resting elevation 'A'. FIG. 6 illustrates further inward threading of set screw 102 which defines a lower resting elevation 'B'. Correspondingly, set screw 102 also limits the pivotal movement of launcher 70 relative to support block 56. The position of set screw 102 may be adjusted when support block 56 is removed from support bar 48.

An alternate construction might also be employed whereby the threaded opening 100 and set screw 102 are provided within launcher 70, with the set screw being adapted for bearing against support block 56. Such a construction would enable adjustability of the elevation of arrow rest groove 78 without having to remove the support block 56 from support bar 48. Regardless of the embodiment, set screw 102 is preferably treated to provide somewhat of an interference fit between it and threaded opening 100 to prevent inadvertent threading in use of set screw 102 relative to opening 100. This assists in maintaining the rest in the desired set-up. Use of such a treated set screw has been deemed not required for set screw 96 as the force of spring 84 against screw 96 keeps it in the desired adjustment.

As will be apparent, inward threading of stop set screw 102, in addition to changing the predetermined launcher elevation, also has the effect of compressing spring 84 and correspondingly changing its compression. Outward threading of tension set screw 96 would compensate for the increased compression generated by inward threading of stop set screw 102, as illustrated.

The described arrow rest apparatus enables an archer to change the relative lateral position of an arrow rest launcher relative to the bow handle without risk of changing the rest groove elevation. Set screw 62 can be released to enable the archer to position launcher V-groove 78 laterally relative to support bar 48 (and accordingly the bow) without affecting the elevation thereof. Additionally, set screw 102 enables the predetermined elevation of V-groove 78 to also be adjusted. Further, the inward tapering of spring 84 enables more consistent performance and adjustability of the tension in launcher spring 84. Archery bows incorporating this unique arrow rest are easier and more convenient for an archer to use.

In compliance with the statute, the invention has been described in language more or less specific as to structural features. It is to be understood, however, that the invention is not limited to the specific features shown and described, since the means and construction herein disclosed comprise a preferred form of putting the invention into effect. The invention is, therefore, claimed in any of its forms or modifications within the proper scope of the appended claims, appropriately interpreted in accordance with the doctrine of equivalents.

We claim:

1. An arrow rest apparatus for an archery bow comprising:

an arrow launcher having fore and aft ends, an upper surface and a bottom surface, and a transverse width; the launcher having means for supporting an arrow at its fore end;

an upwardly open transverse slot extending downwardly into the launcher from the upper surface at a position between the launcher fore and aft ends, the slot having a slot extending along the transverse width and base;

a support block supporting the arrow launcher, the support block having at least one upwardly projecting side member; the launcher being received adjacent the at least one side member;

a pivot pin connected to and extending from the at least one side member of the support block and being received through the launcher slot;

a spring of predetermined compression upwardly biasing the fore end of the launcher, and biasing the slot base of the launcher pivotally against the pivot pin;

stop means for limiting upward pivotal movement of the fore end of the launcher relative to the support block to a predetermined resting elevation; and means for attaching the support block to an archery bow.

2. An arrow rest apparatus for an archery bow comprising:

an arrow launcher having fore and aft ends, an upper surface and a bottom surface, and a transverse width; the launcher having means for supporting an arrow at its fore end;

a first opening formed in the launcher and extending downwardly into the launcher from the launcher upper surface, the first opening being threaded and having a predetermined average diameter;

a compression set screw received in the first threaded opening;

a second opening being formed in the launcher and extending upwardly into the launcher from the launcher bottom surface, the second opening communicating with the first threaded opening, the second opening having a predetermined width which is at least as great as the first threaded opening average diameter;

a support block pivotally supporting the arrow launcher;

a spring of predetermined compression engaging the launcher and upwardly biasing the fore end of the launcher, the spring being received by the second opening and engaging the set screw for enabling the compression of the spring to be adjusted;

a disk being received within the second opening and being interposed between the spring and first threaded opening;

stop means for limiting upward pivotal movement of the fore end of the launcher relative to the support block to a predetermined resting elevation; and means for attaching the support block to an archery bow.

3. The arrow rest apparatus of claim 2 wherein the predetermined width of the second opening is greater than the first threaded opening average diameter.

4. An arrow rest apparatus for an archery bow comprising:

an elongated base which is mountable to an archery bow;

an elongated support bar extending generally perpendicularly from adjacent one end of the base, the support bar being pivotal relative to the base;

locking means for securing the support bar to the base at selective angular positions relative to the base;

a support block;

support means for slidably supporting the support block on the elongated support bar and for enabling sliding movement of the support block along the support bar but precluding any rotation of the support block about the support bar;

the support block including a releasable clamping means engaging the support bar for selectively locking the support block at selected positions along the support bar;

an elongated arrow launcher having fore and aft ends and an upper elongated surface and a bottom elongated surface, the launcher being pivotally mounted to the support block for pivoting about a generally horizontal pivot axis positioned between the launcher fore and aft ends, the launcher including an arrow receiving portion at its fore end;

a first threaded opening formed in the launcher at a point forward of the pivot axis and extending downwardly into the launcher from the launcher upper surface, the first threaded opening having a predetermined average diameter;

a counterbore being formed in the launcher and extending upwardly into the launcher from the launcher bottom surface, the counterbore being longitudinally aligned with and communicating with the first threaded opening, the counterbore having a predetermined average diameter which is greater than the first threaded opening average diameter;

a coil spring of predetermined compression engaging the support block at a location forward of the horizontal launcher pivot axis and extending into the counterbore of the launcher, the coil spring upwardly biasing the fore end of the launcher, the coil spring being tapered along its length to alleviate any tendency of the spring to bow outwardly upon compression;

a disk being received within the counterbore and being interposed between the coil spring and first threaded opening;

a compression set screw mounted in the first threaded opening and engaging the disk for adjusting the compression of the spring and accordingly the force required to pivot the arrow launcher about its pivot axis; and stop means positioned aft of the pivot axis for limiting upward pivotal movement of the fore end of the launcher relative to the support block to a predetermined resting elevation.

5. The arrow rest apparatus of claim 4 wherein the stop means is movably mounted on the arrow rest for adjustably limiting the pivotal movement of the launcher relative to the support block, the stop means further including, (1) a second threaded opening formed in the support block, and (2) a stop set screw mounted in the second threaded opening for engaging the launcher to limit the pivotal movement of the launcher.

6. The arrow rest apparatus of claim 5 wherein, the support block includes a pair of upwardly projecting side walls defining a channel therebetween, the launcher being received between the side walls within the channel;

a pivot pin is connected to and extends between the side walls;

the launcher includes an upper elongated surface and a transverse width, a transverse slot extending downwardly into the launcher from the upper surface and across the launcher width at a position between the launcher fore and aft ends, the slot having a slot base;

the pivot pin is received through the launcher slot; and the coil spring biasing the slot base of the launcher upwardly and pivotally against the pivot pin.

7. An archery bow incorporating the arrow rest of claim 6.

8. An arrow rest apparatus for an archery bow comprising:

an elongated base which is mountable to an archery bow;

an elongated support bar extending generally perpendicularly from adjacent one end of the base, the support bar being pivotal relative to the base; locking means for securing the support bar to the base at selective angular positions relative to the base;

a support block;

support means for slidably supporting the support block on the elongated support bar for enabling sliding movement of the support block along the support bar but precluding any rotation of the support block about the support bar;

the support block including a releasable clamping means engaging the support bar for selectively locking the support block at selected positions along the support bar;

an elongated arrow launcher having fore and aft ends, the launcher being pivotally mounted to the support block for pivoting about a generally horizonal pivot axis positioned between the launcher fore and aft ends, the launcher including an arrow receiving portion at its fore end;

a spring of predetermined compression, extending between and engaging the support block and the launcher at a location forward of the pivot axis, the spring upwardly biasing the fore end of the launcher;

adjustment means for adjusting the compression in the spring and accordingly the force required to pivot the arrow launcher about its pivot axis;

stop means positioned aft of the pivot axis for limiting upward pivotal movement of the fore end of the launcher relative to the support block to a predetermined resting elevation;

the support block including a pair of upwardly projecting side walls defining a channel therebetween, the launcher being received between the side walls within the channel;

a pivot pin being connected to and extending between the side walls;

the launcher including an upper elongated surface and a transverse width, an upwardly open transverse slot extending downwardly into the launcher from the upper surface and across the launcher width at a position between the launcher fore and aft ends, the slot having a slot base;

the pivot pin being received through the launcher slot; and the spring biasing the slot base of the launcher upwardly and pivotally against the pivot pin.

9. An arrow rest apparatus for an archery bow comprising:

an elongated base mountable to an archery bow;

an elongated support bar extending generally perpendicularly from adjacent one end of the base, the support bar being pivotal relative to the base;

locking means for securing the support bar to the base at selective angular positions relative to the base;

a support block;

support means for slidably supporting the support block on the elongated support bar enabling sliding movement of the support block along the support bar;

the support block including a releasable clamping means engaging the support bar for selectively locking the support block at selected positions along the support bar;

an elongated arrow launcher having fore and aft ends, the launcher being pivotally mounted to the support block for pivoting about a generally horizontal pivot axis positioned between the launcher fore and aft ends, the launcher including an arrow receiving portion at its fore end;

a spring of predetermined tension extending between and engaging the support block and the launcher at a location forward of the pivot axis, the spring upwardly biasing the fore end of the launcher; and stop means positioned aft of the pivot axis for limiting upward pivotal movement of the fore end of the launcher relative to the support block to a predetermined resting elevation, the stop means comprising a stop threaded opening formed in one of the launcher or support block, a stop set screw being received by the stop threaded opening and engaging the other of the launcher or support block to enable selective adjustment of the resting elevation;

the support block including a pair of upwardly projecting side walls defining a channel therebetween, the launcher being received between the side walls within the channel;

a pivot pin connected to and extending between the side walls;

the launcher including an upper elongated surface and a transverse width, an upwardly open transverse slot extending downwardly into the launcher from the upper surface and across the launcher width at a position between the launcher fore and aft ends, the slot having a slot base;

the pivot pin being received through the launcher slot; and the spring biasing the slot base of the launcher upwardly and pivotally against the pivot pin.

10. The arrow rest apparatus of claim 9 wherein, the stop threaded opening is formed in and the stop set screw is received by the support block, the support block being slidable and removable from the support bar upon releasing the clamping means for accessing the stop set screw.

11. An arrow rest apparatus for an archery bow comprising:

an elongated base which is mountable to an archery bow;

an elongated support bar extending generally perpendicular from adjacent one end of the base, the support bar being pivotal relative to the base;

locking means for securing the support bar to the base at selective angular positions relative to the base;

a support block;

support means for slidably supporting the support block on the elongated support bar and for enabling sliding movement of the support block along the support bar;

the support block including a releaseable clamping means engaging the support bar for selectively locking the support block at selected positions along the support bar;

an elongated arrow launcher having fore and aft ends and an upper elongated surface and a bottom elongated surface, the launcher being pivotally mounted to the support block for pivoting about a generally horizontal pivot axis positioned between the launcher fore and aft ends, the launcher including an arrow receiving portion at its fore end;

a first threaded opening formed in the launcher at a point forward of the pivot axis and extending downwardly into the launcher from the launcher upper surface, the first threaded opening having a predetermined average diameter;

a counterbore being formed in the launcher and extending upwardly into the launcher from the launcher bottom surface, the counterbore being longitudinally aligned with and communicating with the first threaded opening, the counterbore having predetermined average diameter which is greater than the first threaded opening average diameter;

a coil spring of predetermined compression engaging the support block at a location forward of the horizontal launcher pivot axis and extending into the counterbore of the launcher, the coil spring upwardly biasing the fore end of the launcher, the coil spring being tapered along its length to alleviate any tendency of the spring to bow outwardly upon compression;

a disk being received within the counterbore and being interposed between the coil spring and first threaded opening;

a compression set screw mounted in the first threaded opening and engaging the disk for adjusting the compression of the spring and accordingly the force required to pivot the arrow launcher about its pivot axis;

stop means positioned aft of the pivot axis for limiting upward pivotal movement of the fore end of the launcher relative to the support block to a predetermined resting elevation, the stop means comprising a stop threaded opening formed in one of the launcher or support block, a stop set screw being received by the stop threaded opening and engaging the other of the launcher or support block to enable selective adjustment of the resting elevation; and adjustment means for adjusting the compression of the coil spring and accordingly the force required to pivot the arrow launcher about its pivot axis, the adjustment means comprising:

an adjustment threaded opening formed in the launcher and extending downwardly into the launcher from the launcher upper surface; and a compression set screw mounted in the adjustment threaded opening and engaging the spring for adjusting the compression of the spring.

12. An archery bow incorporating the arrow rest of claim 11.

13. An arrow rest apparatus for an archery bow comprising:

an elongated base mountable to an archery bow;

an elongated support bar extending generally perpendicularly from adjacent one end of the base, the support bar being pivotal relative to the base;

locking means for securing the support bar to the base to enable selective angular positioning of the support bar relative to the base;

a support block mounted to the support bar;

a dovetail sliding interconnection being formed between the support bar and support block, the dovetail interconnection enabling sliding movement of the support block along the support bar but precluding any rotation of the support block about the support bar, and precluding removal of the support block from the support bar other than by sliding the support block from the support bar adjacent one end of the support bar;

the support block including a locking set screw and a locking threaded opening, the locking set screw being received by the locking threaded opening, the locking set screw engaging the support bar to enable selective locking of the support block from sliding relative to the support bar, the support block including a pair of upwardly projecting side walls defining a channel therebetween;

a pivot pin connected to and extending between the support block side walls;

an elongated arrow launcher having fore and aft ends, an upper elongated surface, and a transverse width; an upwardly open transverse slot extending downwardly into the launcher from the upper surface and across the launcher width at a position between the launcher fore and aft ends; the slot having a slot base; the launcher being received between the support block side walls within the channel; the pivot pin being received through the launcher slot; the launcher including an arrow receiving portion at its fore end;

a coil spring of predetermined compression extending between and engaging the support block and the launcher at a location forward of the pivot pin, the coil spring biasing the launcher slot base upwardly and pivotally against the pivot pin for pivoting of the launcher about a generally horizontal pivot axis, the coil spring being tapered inwardly along its length for alleviating any tendency of the spring to bow outwardly upon compression;

a first threaded opening formed in the launcher and extending to a location where the coil spring engages the launcher, a compression set screw being received in the first threaded opening and engaging one end of the coil spring to enable selective adjustment of the compression in the coil spring and accordingly the force required to pivot the arrow launcher about its pivot axis; and stop means positioned aft of the pivot axis for limiting upward pivotal movement of the fore end of the launcher relative to the support block to a predetermined resting elevation, the stop means comprising a second threaded opening formed in the support block at a location aft of the pivot axis, a stop set screw being received in the second threaded opening and engaging the launcher at a location aft of the pivot axis to enable selective adjustment of the resting elevation.

14. An arrow rest apparatus for an archery bow comprising:

an elongated base mountable to an archery bow;

an elongated support bar extending generally perpendicularly from adjacent one end of the base, the support bar being pivotal relative to the base;

locking means for securing the support bar to the base to enable selective angular positioning of the support bar relative to the base;

a support block mounted to the support bar;

a dovetail sliding interconnection being formed between the support bar and support block, the dovetail interconnection enabling sliding movement of the support block along the support bar but precluding any rotation of the support block about the support bar, and precluding removal of the support block from the support bar other than by sliding the support block from the support bar adjacent one end of the support bar;

the support block including a locking set screw and a locking threaded opening, the locking set screw being received by the locking threaded opening, the locking set screw engaging the support bar to enable selective locking of the support block from sliding relative to the support bar, the support block including a pair of upwardly projecting side walls defining a channel therebetween;

a pivot pin connected to and extending between the support block side walls;

an elongated arrow launcher having fore and aft ends, an upper elongated surface, and a transverse width; a transverse slot extending downwardly into the launcher from the upper surface and across the launcher width at a position between the launcher fore and aft ends; the slot having a slot base; the launcher being received between the support block side walls within the channel; the pivot pin being received through the launcher slot; the launcher including an arrow receiving portion at its fore end;

a coil spring of predetermined compression extending between the engaging the support block and the launcher at a location forward of the pivot pin, the coil spring biasing the launcher slot base upwardly and pivotally against the pivot pin for pivoting of the launcher about a generally horizontal pivot axis, the coil spring being tapered inwardly along its length for alleviating any tendency of the spring to bow outwardly upon compression;

a first threaded opening formed in the launcher and extending to a location where the coil spring engages the launcher, a compression set screw being received in the first threaded opening and engaging one end of the coil spring to enable selective adjustment of the compression in the coil spring and accordingly the force required to pivot the arrow launcher about its pivot axis;

stop means positioned aft of the pivot axis for limiting upward pivotal movement of the fore end of the launcher relative to the support block to a predetermined resting elevation, the stop means comprising a second threaded opening formed in the support block at a location aft of the pivot axis, a stop set screw being received in the second threaded opening and engaging the launcher at a location aft of the pivot axis to enable selective adjustment of the resting elevation;

the launcher including a bottom elongated surface;

the first threaded opening having a predetermined average diameter;

a counterbore being formed in the launcher and extending upwardly into the launcher from the launcher bottom surface, the counterbore being longitudinally aligned with and communicating with the first threaded opening the counterbore having a predetermined average diameter which is greater than the first threaded opening average diameter;

the coil spring extending into the counterbore; and a disk being received within the counterbore and being interposed between the coil spring and first threaded opening.

* * * * *